US005787610A

United States Patent [19]

Brooks

[11] Patent Number: 5,787,610

[45] Date of Patent: Aug. 4, 1998

[54] FOOTWEAR

[75] Inventor: Jeffrey S. Brooks, St. Louis County, Mo.

[73] Assignee: Jeffrey S. Brooks, Inc., Creve Coeur, Mo.

[21] Appl. No.: 861,579

[22] Filed: May 22, 1997

Related U.S. Application Data

[63] Continuation-in-part of Ser. No. 654,726, May 29, 1996, abandoned.

[51] Int. Cl.[6] ..... A43B 13/18; A43B 13/14

[52] U.S. Cl. ..... 36/28; 36/31; 36/174; 36/169

[58] Field of Search ..... 36/25 R, 28, 30 R, 36/31, 32, 169, 174–182

[56] References Cited

U.S. PATENT DOCUMENTS

| | | |
|---|---|---|
| D. 246,551 | 12/1977 | Hansjosten et al. . |
| D. 302,764 | 8/1989 | Peoples et al. . |
| D. 362,956 | 10/1995 | Martin et al. . |
| 1,055,768 | 3/1913 | Levee et al. . |
| 1,137,092 | 4/1915 | Sharp . |

(List continued on next page.)

FOREIGN PATENT DOCUMENTS

| | | |
|---|---|---|
| 0 427 556A2 | 5/1991 | European Pat. Off. . |
| 0 591 909A1 | 4/1994 | European Pat. Off. . |
| 1207258 | 2/1960 | France . |
| 1413280 | 8/1965 | France . |
| 2015914 | 8/1969 | France . |
| 2272618 | 3/1975 | France . |
| 2309169 | 5/1975 | France . |
| 2427801 | 6/1978 | France . |
| 2506132 | 11/1982 | France . |
| 875466 | 3/1953 | Germany . |

OTHER PUBLICATIONS

Packaging for Sorbothane Full–Sole Insert (1981).

Packaging for Sorbothane Sport Sole Insert (1983).

Advertisement for Sorbothane, date unknown.

Forefoot Varus Biomechanical Compendium, The Biomechanical Research and Educational Laboratory, date unknown.

Sporthotics® Insole (photographs marked "A1–A6") made by The Langer Biomechanics Group, Inc., date of first public use unknown.

Sporthotics® Insole (photographs marked "B1–B6") made by The Langer Biomechanics Group, Inc., date of first public use unknown.

Sporthotics® Insole (photographs marked "C1–C6") made by The Langer Biomechanics Group, Inc., date of first public use unknown.

*Primary Examiner*—Ted Kavanaugh

*Attorney, Agent, or Firm*—Senniger, Powers, Leavitt & Roedel

[57] ABSTRACT

Footwear comprising a sole formed from a first resilient material for attenuating the shock of impact to a wearer during running or walking, and a second material harder than the first material for providing firm support for a foot. The sole has heel, arch and toe sections, each of which have medial and lateral regions. The sole also has a forefoot section having a first region for supporting the first, second, third, fourth and fifth metatarsal heads of the foot, associated phalanges and metatarsal phalangeal joints, and the metatarsal necks associated with the fourth and fifth metatarsal heads, and a second region for supporting the metatarsal necks associated with the second and third metatarsal heads. The sole is formed so that the first resilient material is positioned in the lateral region of the heel section, the lateral region of the arch section, and the first region of the forefoot section, and so that the second harder material is positioned in the medial region of the arch section, and the second region of the forefoot section.

15 Claims, 3 Drawing Sheets

U.S. PATENT DOCUMENTS 1,544,625 7/1925 Austin .
1,828,086 10/1931 Tweedie .
2,008,207 7/1935 Greenberg .
2,034,463 3/1936 Dvlinsky .
2,046,732 7/1936 Fein .
2,081,474 5/1937 Burns .
2,097,759 11/1937 Ehrlich .
2,119,807 6/1938 Farley .
2,255,100 9/1941 Brady .
2,346,279 4/1944 Stritter .
2,379,000 6/1945 Gould .
2,413,534 12/1946 Watson .
2,460,493 2/1949 Diamant .
2,505,032 4/1950 De Voos .
2,658,288 11/1953 Scholl .
2,814,133 11/1957 Herbst .
2,821,032 1/1958 Helfet .
2,828,555 4/1958 Ledos .
2,863,231 12/1958 Jones .
3,068,872 12/1962 Brody .
3,099,267 7/1963 Cherniak .
3,187,069 6/1965 Pincus et al. .
3,233,348 2/1966 Gilkerson .
3,309,797 3/1967 Poitras .
3,333,353 8/1967 Garcia .
3,416,245 12/1968 Ferreira .
3,449,844 6/1969 Spence .
3,530,489 9/1970 Appleton .
3,638,336 2/1972 Silverman .
3,643,353 2/1972 Weight .
3,730,169 5/1973 Fiber .
3,781,231 12/1973 Janssen et al. .
3,842,519 10/1974 Lapidus .
3,847,720 11/1974 Laberinti .
3,935,044 1/1976 Daly .
4,003,146 1/1977 Meier et al. .
4,054,706 10/1977 Shapiro .
4,055,699 10/1977 Hsiung .
4,084,333 4/1978 Del Vecchio .
4,101,704 7/1978 Hiles .
4,137,654 2/1979 Hlavac .
4,168,585 9/1979 Gleichner .
4,187,621 2/1980 Cohen .
4,188,736 2/1980 Keller .
4,235,026 11/1980 Plagenhoef .
4,268,980 5/1981 Gudas .
4,272,899 6/1981 Brooks .
4,285,144 8/1981 Power .
4,292,263 9/1981 Hanrahan et al. .
4,296,053 10/1981 Doerer et al. .
4,302,892 12/1981 Adamik .
4,307,521 12/1981 Inohara et al. .
4,316,335 2/1982 Giese et al. .
4,345,387 8/1982 Daswick .
4,346,205 8/1982 Hiles .
4,346,525 8/1982 Larsen et al. .
4,364,189 12/1982 Bates .
4,372,059 2/1983 Ambrose .
4,378,642 4/1983 Light et al. .
4,398,357 8/1983 Batra .
4,408,402 10/1983 Looney .
4,418,483 12/1983 Fujita et al. .
4,435,910 3/1984 Marc .
4,455,340 6/1984 Okina .
4,490,928 1/1985 Kawashima .
4,506,462 3/1985 Cavanagh .
4,510,700 4/1985 Brown .
4,510,702 4/1985 Ehrlich, Jr. .
4,513,518 4/1985 Jalbert et al. .
4,515,851 5/1985 Johnson .
4,517,981 5/1985 Santopietro et al. .
4,527,345 7/1985 Lopez Lopez .
4,541,184 9/1985 Leighton .
4,541,186 9/1985 Mulvihill .
4,557,060 12/1985 Kawashima .
4,564,966 1/1986 Chen .
4,581,187 4/1986 Sullivan et al. .
4,586,273 5/1986 Chapnick .
4,608,988 9/1986 Dananberg .
4,615,126 10/1986 Mathews .
4,619,053 10/1986 Schumacher .
4,627,177 12/1986 Meyers .
4,627,178 12/1986 Sullivan et al. .
4,627,179 12/1986 McElroy .
4,633,598 1/1987 Moronaga et al. .
4,633,877 1/1987 Pendergast .
4,642,912 2/1987 Wildman et al. .
4,651,445 3/1987 Hannibal .
4,674,204 6/1987 Sullivan et al. .
4,677,766 7/1987 Gudas .
4,694,591 9/1987 Banich et al. .
4,702,255 10/1987 Schenkl .
4,739,765 4/1988 Sydor et al. .
4,754,561 7/1988 Dufour .
4,757,620 7/1988 Tiitola .
4,769,926 9/1988 Meyers .
4,777,739 10/1988 Hiles .
4,782,605 11/1988 Chapnick .
4,798,010 1/1989 Sugiyama .
4,808,469 2/1989 Hiles .
4,823,483 4/1989 Chapnick .
4,841,647 6/1989 Turucz .
4,854,057 8/1989 Misevich et al. .
4,864,739 9/1989 Maestri .
4,876,805 10/1989 Peoples .
4,879,821 11/1989 Graham et al. .
4,882,856 11/1989 Glancy .
4,908,961 3/1990 Purslow et al. .
4,910,886 3/1990 Sullivan et al. .
4,955,148 9/1990 Padilla .
4,977,691 12/1990 Orchard, 3rd .
5,024,007 6/1991 DuFour .
5,042,174 8/1991 Nichols .
5,077,915 1/1992 Gross .
5,131,173 7/1992 Anderié .
5,146,698 9/1992 Tilles et al. .
5,282,326 2/1994 Schroer, Jr. et al. .
5,319,866 6/1994 Foley et al. .
5,384,973 1/1995 Lyden .
5,448,839 9/1995 Blissett et al. .
5,465,507 11/1995 Schumacher et al. .
5,572,805 11/1996 Giese et al. .
5,592,757 1/1997 Jackinsky .
5,611,153 3/1997 Fisher et al. .
B1 4,910,886 5/1995 Sullivan et al. .

FOREIGN PATENT DOCUMENTS

K22803 7/1957 Germany .
303241 11/1932 Italy .
362452 8/1938 Italy .
217833 6/1924 United Kingdom .
452492 5/1935 United Kingdom .
1243575 8/1971 United Kingdom .
1564195 4/1980 United Kingdom .
2057964 4/1981 United Kingdom .
2088776 6/1982 United Kingdom .

FOOTWEAR

CROSS-REFERENCE TO RELATED APPLICATION

This is a continuation-in-part of application Ser. No. 08/654,726, filed May 29, 1996, now abandoned.

BACKGROUND OF THE INVENTION

This invention relates generally to footwear representing an improvement on the design described in my U.S. Pat. No. 4,272,899 which is hereby incorporated by reference.

The footwear of the present invention comprises a sole of composite construction, that is, the sole is formed of a first material positioned for attenuating the impact forces applied to the foot and other skeletal structures during standing, walking and running, and a second harder material for firmly supporting the foot.

When walking and running, the lateral (outside) portion of the heel is generally the first part of the foot to strike the ground, with the foot then pivoting on the heel to bring the lateral part of the forefoot into contact with the ground. At this point, the foot is supinated (inclined upwardly from the lateral to the medial side of the foot), but rapidly pronates to a neutral position in which the bottom of the heel and the metatarsal heads of the forefoot are in contact with the ground, and in which the central vertical plane of the heel is ideally generally perpendicular to the ground. During this sequence of movements, various muscles and tendons contract to stabilize the foot in preparation for movement from the neutral position back to a supinated position prior to the propulsive phase of the gait cycle. (The propulsive phase is sometimes referred to as toe-off or push-off.) The arch (i.e., the bone structural alignment) of the foot should be firmly supported when the foot is in the neutral position in order to prevent the ligaments, muscles and tendons from becoming over stressed. During toe-off, it is preferable that the second and third metatarsals be firmly supported, and that the first metatarsal head plantarflex (move downward) relative the second and third metatarsal heads. The toes also should be firmly supported during push-off so that they remain straight and thus stronger due to the pillar effect of the phalanges.

In view of the foregoing, it will be observed that certain parts of the foot are subjected to higher stress during standing, running and walking, and that other parts of the foot require different degrees of support for maximum biomechanical efficiency. Moreover, high impact forces to the foot are transferred to other skeletal structures such as the shins and knees. The present invention takes these considerations into account and provides the appropriate amount of shock attenuation and support to different regions of the foot, thus protecting those parts of the foot which are subjected to high impact forces, and allowing other parts of the foot to function in a way which provides maximum efficiency to prepare the body for stresses placed on it.

SUMMARY OF THE INVENTION

Among the several objects of this invention may be noted the provision of footwear which is tailored to the biomechanical operation of a wearer's foot; the provision of optimizing footwear to one or more of the various needs of a particular wearer and/or task by providing an appropriate amount of support and cushioning applied to regions of the particular wearer's foot; and the provision of the present invention which may be incorporated in the soles of footwear such as shoes, boots and sandals, or in insoles for placement inside shoes and the like.

In general, improved footwear of this invention comprises a sole formed in part from a first resilient material for attenuating the shock of impact to the wearer during running or walking, and in part from a second harder material for providing firm support for the foot. The sole has a heel section for supporting a heel of the foot, the heel section having medial and lateral regions. The sole also has an arch section forward of the heel section for supporting an arch of the foot. The arch section has medial and lateral regions. A forefoot section is located forward of the arch section for supporting a ball of the foot including first, second, third, fourth and fifth metatarsal heads and associated metatarsal necks, proximal phalanges and metatarsal phalangeal joints. The forefoot section has a first region for supporting the first, second, third, fourth and fifth metatarsal heads, associated phalanges and metatarsal phalangeal joints, and the metatarsal necks associated with the fourth and fifth metatarsal heads, and a second region for supporting the metatarsal necks associated with the second and third metatarsal heads. The sole is formed so that the first resilient material is located in the lateral region of the heel section, the lateral region of the arch section, and the first region of the forefoot section. The second harder material is located in the medial region of the arch section and the second region of the forefoot section.

Other objects and features of this invention will be in part apparent and in part pointed out hereinafter

BRIEF DESCRIPTION OF THE DRAWINGS

Corresponding parts are designated by corresponding reference characters throughout the several views of the drawings.

DETAILED DESCRIPTION OF THE PREFERRED EMBODIMENTS

Figure 1:
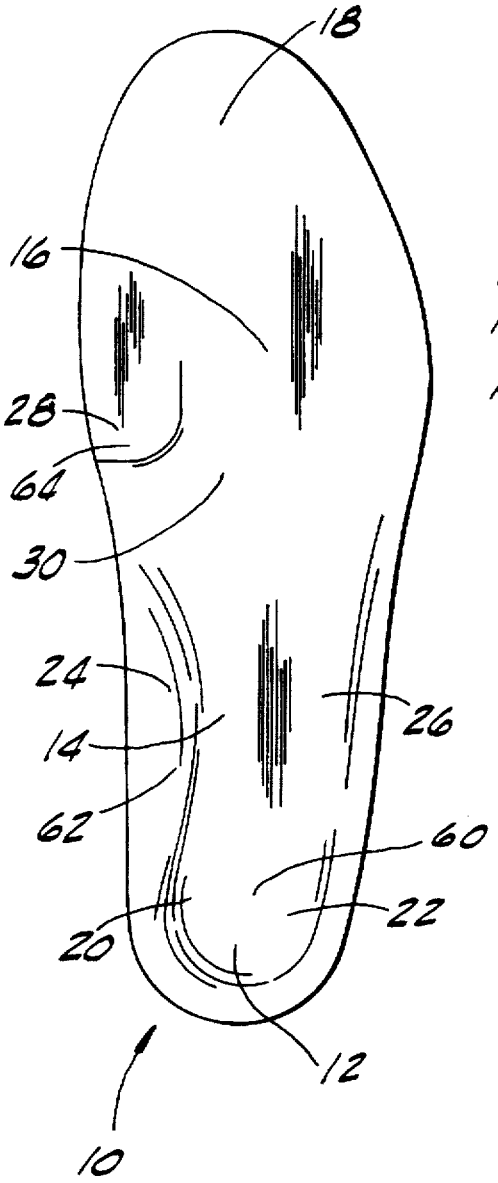
FIG. 1 is a top view of a sole of the present invention for the right foot.
Figure 2:
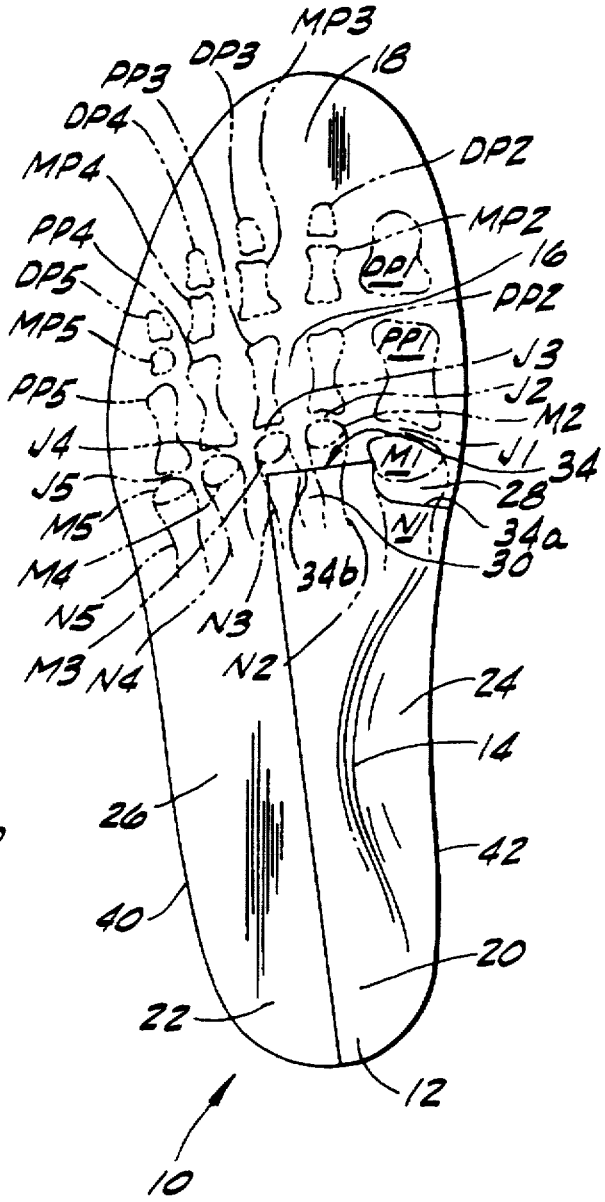
FIG. 2 is an underside view of the sole of FIG. 1 showing its composite construction.

Referring to FIGS. 1 and 2 of the drawings, footwear of the present invention comprising a sole is designated in its entirety by the reference numeral 10. The sole 10 is shown as having four sections, a heel section 12, an arch section 14, a forefoot section 16, and a toe section 18, corresponding to parts of a wearer's foot. In use, the heel section 12 underlies the heel of the wearer's foot and includes medial and lateral regions designated 20, 22, respectively, corresponding to the inner and outer sides of the foot, respectively. Likewise, the arch section 14, which is forward of the heel section 12, underlies the arch of the wearer's foot and also includes medial and lateral regions 24, 26, respectively. The forefoot section 16 is forward of the arch section 14 and underlies the ball of the foot, the latter of which includes the first, second, third, fourth and fifth metatarsal heads indicated in phantom at M1–M5 in FIG. 2. The ball of the foot also includes first, second, third, fourth and fifth metatarsal necks (N1–N5) associated with the metatarsal heads, first, second, third, fourth and fifth proximal phalanges (PP1–PP5) forward of the respective metatarsal heads, and associated metatarsal phalangeal joints (J1–J5) between the metatarsal heads and proximal phalanges. The forefoot section 16 is divided into first and second regions designated 28 and 30, respectively. The first region 28 is adapted to underlie all five metatarsal heads M1–M5, the fourth and fifth metatarsal necks N4 and N5, the proximal phalanges PP1–PP5, and the metatarsal phalangeal joints J1–J5. The second region 30 underlies and supports the second and third metatarsal necks N2, N3. Regions 28 and 30 are defined by a boundary line generally designated 34 having a forward medial (inner) segment **34*a* and a lateral (outer) segment 34*b*. As illustrated in FIG. 2, the medial (inner) segment 34*a* of boundary line 34 is offset rearwardly with respect to lateral segment 34*b* of the line to accommodate the first metatarsal head. Segment 34*a* passes directly beneath the neck of the first metatarsal head, and segment 34*b* passes directly beneath the necks of the second and third metatarsal necks. The toe section 18 of the sole is spaced forward of the forefoot section 16** and underlies at least the middle phalanges MP2–MP5 and distal phalanges DP1–DP5 of the toes of the wearer's foot.

In accordance with the present invention, the sole 10 is formed so that a resilient material is located in the lateral region of the heel section, the lateral region of the arch section, the first region of the forefoot section and the toe section. A harder material is located in the medial region of the heel section, the medial region of the arch section and the second region of the forefoot section. This configuration is best illustrated in FIG. 2, which shows the softer material formed as a first, preferably unitary body 40 having a shape generally resembling the numeral "7", and the harder material formed as a second, preferably unitary body 42 attached to the first body directly to the right of and below the first body 40.

Figure 3:
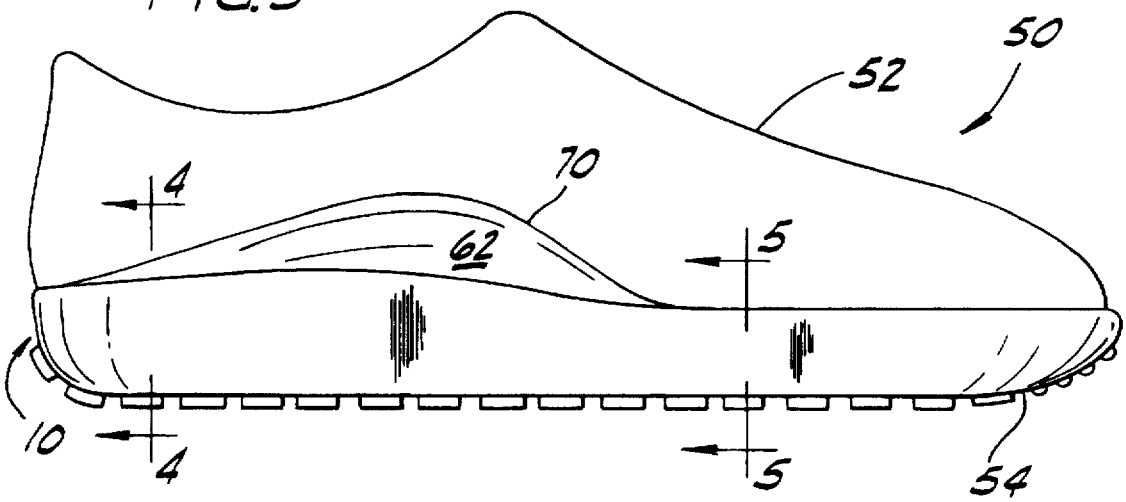
FIG. 3 is a right side (lateral) elevation of a shoe having a sole which incorporates the present invention.
Figure 4:
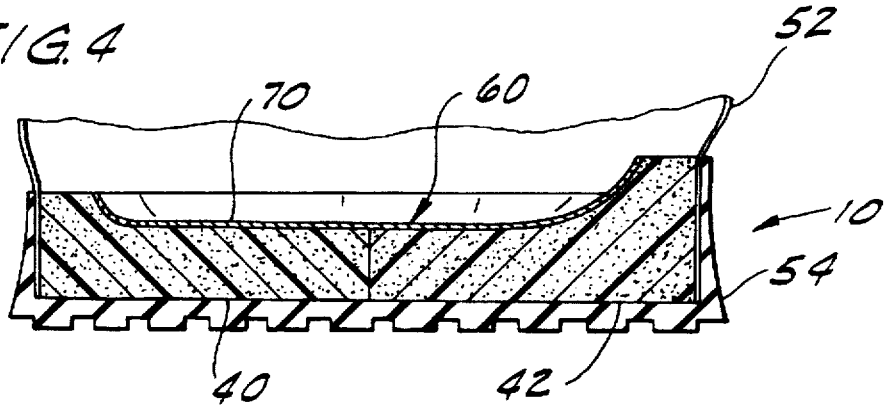
FIG. 4 is a cross-section taken in the plane of line 4—4 of FIG. 3.
Figure 5:
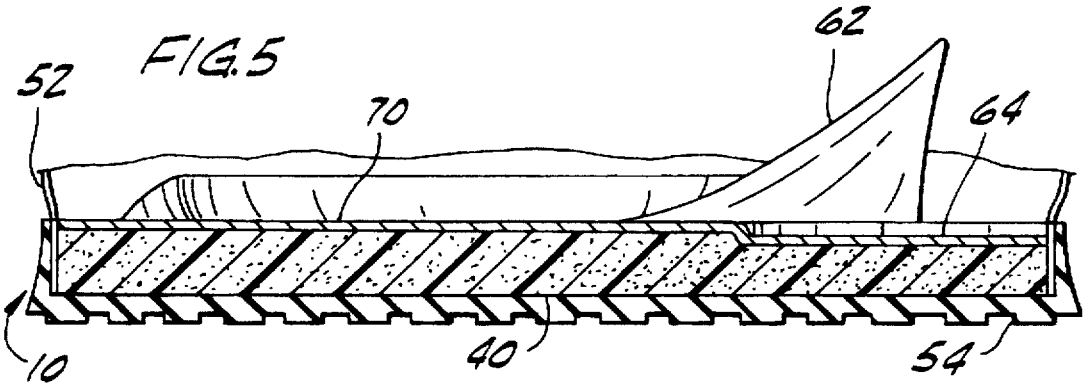
FIG. 5 is a cross-section taken in the plane of line 5—5 of FIG. 3.

FIGS. 3–5 show the sole 10 incorporated in a shoe, indicated generally at 50, having an upper 52 secured to the sole in a suitable fashion. The sole 10 comprises the two bodies 40, 42 (FIG. 4) located in side-by-side relation. The body 40 of softer material preferably has a Type C (commonly referred to as "Shore C scale") durometer hardness measured in accordance with American Society of Testing and Materials (ASTM) standard D 2440-97 of less than about 70 and more preferably a hardness in a range of about 40–60. Depending upon the particular activity for which the footwear is intended, the hardness may be different. For instance, if the footwear is intended for walking, the body 40 of softer material may have a Type C durometer hardness (ASTM D 2240-97) of about 45, whereas if the footwear is intended of running, the body 40 may have a hardness of about 60. In short, the body 40 should be sufficiently "soft" to provide shock attenuation, but sufficiently firm to provide stability to the foot. The body 42 of harder material preferably has a Type C durometer hardness (ASTM D 2240-97) of 50–85, and preferably greater than about 60. For footwear (e.g. work boots) subjected to heavy loading, the body 42 preferably has a hardness of about 75.

The two bodies 40, 42 or sections of the sole can be bonded to one another in any suitable fashion, as by heat fusion, adhesive, or by a chemical or curing process. The two bodies can be formed of any suitable sole material, such as polyurethane, TPR, PVC, EVA or other materials well known to those of ordinary skill in the art of footwear. Also, the two bodies 40 and 42 can be made of a single material (e.g., PVC or EVA) having different durometer hardnesses, or of different materials having different durometer hardnesses. In addition, the two bodies may be made of different colored materials to enhance the aesthetic characteristics of the insole and to highlight the use of multiple materials for marketability.

The composite sole described above formed by the two bodies 40, 42 may be used in lieu of a midsole of a conventional shoe, in which case the bodies may be permanently bonded or otherwise integrally attached to a wear resistant outsole 54, or the bodies may be used in lieu of a conventional one-piece cup sole. The thicknesses and contours of bodies 40 and 42 may be individually designed to compensate for the various characteristics of a particular wearer or group of wearers. For example, the upper surfaces of the two bodies 40, 42 may be appropriately contoured for the foot of the person wearing the footwear. Further, the upper surfaces of the bodies 40, 42 may be formed with a U-shaped heel seat 60 (FIGS. 1 and 4), an arch support 62 (FIGS. 1, 3 and 5) and a bunion cradle 64 (FIGS. 1 and 5). Depending upon the physical attributes of the intended wearer, the thicknesses of these formations may be varied to accommodate his or her needs as described in my U.S. Pat. No. 4,272,899.

As illustrated in FIG. 4, a layer of material 70, e.g., elastomeric polymer cloth, covers the entire upper surface of bodies 40 and 42 to form a sock liner and improve the appearance of the sole 10. Further, the liner 70 prevents the sole 10 from adhering to the wearer's foot or clothing. Indicia such as trademarks may printed on the upper surface of the liner. In addition, the liner 70 may be made of an odor and/or moisture absorbing material as is known in the art. Optionally, the liner 70 may also be impregnated with an antibacterial and/or antimicrobial agent.

Thus configured, the sole 10 protects those parts of the foot which are subjected to high impact forces, and supports other parts of the foot to function in a way which provides maximum efficiency and prepares the body for stresses placed on it, thereby reducing the risk of injury. The softer material of the first body 40 compresses relatively easily when loaded. However, the harder material of the second body 42 does not compress easily when loaded. Therefore, the areas of the sole 10 incorporating the softer material of the first body 40 deflect to absorb impact forces, and the areas of the sole incorporating the harder material of the second body 42 resist movement to more firmly support the foot.

As each step is taken, some sections of the foot require more cushioning and others require firmer support. The lateral portion of the heel is generally the first part of the foot to strike the ground. The softer body 40 in the lateral region 22 of the heel section 12 of the sole 10 cushions the initial impact. After the initial impact, the foot pivots downward on the heel, and the lateral portions of the arch and forefoot impact the ground. The softer material in the lateral region 26 of the arch section 14 and in the first region 28 of the forefoot section 16 absorbs the shock of this secondary impact. After the secondary impact, the foot pronates to a neutral position wherein the bottom of the heel and the metatarsal heads M1-M5 of the forefoot contact the ground, and the central vertical plane of the heel is generally perpendicular to the ground. The harder body 42 in the medial region 24 of the arch section 14 firmly supports the osseous alignment of the foot when in the neutral position thereby relieving stress in the ligaments, muscles and tendons which maintain the foot in this position. During toe-off, the harder material of the forefoot section 16 supports the second and third metatarsal necks N2, N3, but the softer material used in the first region 28 of the forefoot section permits the first metatarsal neck N1 and head M1 to plantarflex relative to the second and third metatarsal heads M2, M3. This motion places the foot in an appropriate biomechanical position during the propulsive phase of the gait cycle. This motion also permits the sesamoid apparatus to function properly during mid-stance and toe-off. The softer material under the metatarsal heads M1–M5 also serves to dissipate weight from the mid-stance through the propulsive phases of the gait cycle.

It will be observed from the foregoing that the material properties of the various sole regions appropriately cushion and support various parts of the user's foot. Moreover, the shapes of the first and second bodies 40, 42 enhance the movement and support of the foot. For instance, the bunion cradle 64 of the preferred embodiment permits the first metatarsal head M1 to plantarflex relative to the second and third metatarsal heads M2, M3 during toe-off. Likewise, the arch support 62 and the heel seat 60 support and cradle the osseous structure of the foot to maintain the appropriate neutral position after pronation and to prevent the ligaments, tendons and muscles of the user's feet and legs from being over stressed.

Figure 6:
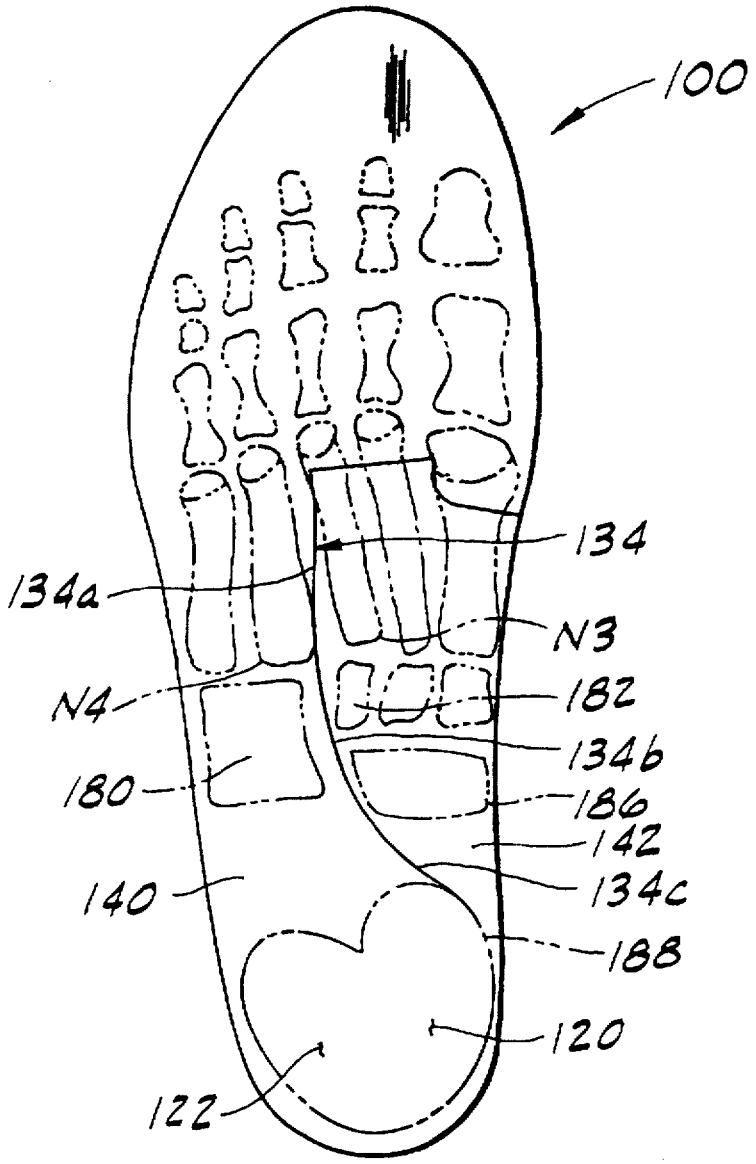
FIG. 6 is a view similar to FIG. 2 showing an alternative embodiment of the present invention.

FIG. 6 illustrates a second embodiment of a sole 100 of the present invention. This version is identical to the sole 10 described above except that the medial and lateral regions of the heel (designated 120 and 122, respectively) are both formed from the same softer material. In other words, the medial region 120 of the heel is not formed from a harder material as in the first embodiment. As shown in FIG. 6, the longitudinal boundary line 134 separating the body 140 of softer material from the body 142 of harder material has a longitudinal segment 134*a* which extends generally between the third and fourth metatarsal necks N3, N4, a segment 134*b* which extends rearwardly between the cuboid bone 180 and the lateral cuneiform bone 182 of the foot, and a segment 134*c* which curves gradually in a rearward and medial direction to the medial side of sole, passing between the navicular bone 186 and the forward end of the medial tuberosity 188 of the heel. This sole design functions in the same manner as the sole design of the first embodiment, except that it provides cushioning for the entire heel area, not just the lateral region of the heel.

It will be appreciated that the hardnesses presented above may be altered depending upon the intended use of the sole. For example, adult footwear designed for use in situations where the wearer will frequently be carrying a heavy load (e.g., work boots) may require more support than a child's dress shoe. Likewise, footwear made for running may require firmer support in the heel section to absorb the initial shock of each step than would a hiking boot in which more cushion may be required.

In addition, it will be appreciated that the present invention is not limited necessarily to any particular type of footwear and may be equally desirable for use in removable insoles, as well as for use in the soles of shoes, boots and sandals. ("Footwear" as used herein includes all of these items and any other item having or consisting of a sole.) Further, it should be understood that the locations and shapes of the areas of softer and harder material may be altered without departing from the scope of this invention. Likewise, the unique configuration of softer and harder material may be employed at any vertical level of a sole or insole to provide the desired support without departing from the scope of the invention. For example, if the sole or insole is laminated, one or more of the laminae may be configured to have the softer and harder materials in the appropriate areas described above.

While the present invention has been described by reference to a specific embodiment, it should be understood that modifications and variations of the invention may be constructed without departing from the scope of the invention defined in the following claims.

What is claimed is:

1. Footwear comprising a sole formed in part from a first resilient material for attenuating the shock of impact to the wearer during running or walking, and in part from a second material harder than said first material for providing firm support for the foot, said sole having:

(a) a heel section for supporting a heel of the foot, said heel section having medial and lateral regions;

(b) an arch section forward of the heel section for supporting an arch of the foot, said arch section having medial and lateral regions; and (c) a forefoot section forward of the arch section for supporting a ball of the foot including first, second, third, fourth and fifth metatarsal heads and associated metatarsal necks, proximal phalanges and metatarsal phalangeal joints, said forefoot section having a first region for supporting the first, second, third, fourth and fifth metatarsal heads, associated phalanges and metatarsal phalangeal joints, and the metatarsal necks associated with the fourth and fifth metatarsal heads, and a second region for supporting the metatarsal necks associated with the second and third metatarsal heads;

said sole being formed so that said first resilient material is located in the lateral region of the heel section, the lateral region of the arch section, and the first region of the forefoot section, and so that said second harder material is located in the medial region of the arch section and the second region of the forefoot section.

2. Footwear as set forth in claim 1 wherein said first resilient material is formed as a body having a shape resembling a numeral seven.

3. Footwear as set forth in claim 2 wherein said first resilient material has a Type C durometer hardness of less than about 70, and wherein said second harder material has a Type C durometer hardness of 50–85.

4. Footwear as set forth in claim 3 wherein said first resilient material has a Type C durometer hardness in the range of about 40–60, and wherein said second harder material has a Type C durometer hardness of about 75.

5. Footwear as set forth in claim 2 wherein said body of said first resilient material is a unitary body and wherein said second harder material is formed as a unitary body permanently bonded to said body of said first material.

6. Footwear as set forth in claim 5 wherein said unitary bodies of said first and second materials are bonded together in side-by-side relation to form at least a portion of said sole.

7. Footwear as set forth in claim 6 further comprising a sock liner overlying upper surfaces of said unitary bodies.

8. Footwear as set forth in claim 7 wherein said sole comprises a midsole, and wherein said footwear further comprises an outsole permanently attached to the midsole for engagement with the ground.

9. Footwear as set forth in claim 1 wherein said first resilient material located in the first region of the forefoot section and said second harder material located in the second region of the forefoot section are adapted to permit the first metatarsal neck and head of the foot to plantarflex relative to the second and third metatarsal heads during toe-off.

10. Footwear as set forth in claim 1 wherein said first material is located in the medial region of the heel section.

11. Footwear as set forth in claim 1 wherein said second material is located in the medial region of the heel section.

12. Footwear as set forth in claim 1 wherein the first and second regions of said forefoot section are defined by a boundary line which extends under the metatarsal necks associated with the first, second and third metatarsal heads.

13. Footwear comprising a sole having:

(a) a heel section for supporting a heel of the foot, said heel section having medial and lateral regions;

(b) an arch section forward of the heel section for supporting an arch of the foot, said arch section having medial and lateral regions; and (c) a forefoot section forward of the arch section for supporting a ball of the foot including first, second, third, fourth and fifth metatarsal heads and associated metatarsal necks, proximal phalanges and metatarsal phalangeal joints, said forefoot section having a first region for supporting the first, second, third, fourth and fifth metatarsal heads, associated phalanges and metatarsal phalangeal joints, and the metatarsal necks associated with the fourth and fifth metatarsal heads, and a second region for supporting the metatarsal necks associated with the second and third metatarsal heads;

said sole being constructed to have a first resilient area for attenuating the shock of impact to the wearer during running and walking, and a second area harder than said first area for providing firm support for the foot during running and walking, said first area comprising the lateral region of the heel section, the lateral region of the arch section, and the first region of the forefoot section, and said second area comprising the medial region of the arch section and the second region of the forefoot section.

14. Footwear as set forth in claim 13 wherein said first area further comprises the medial region of the heel section.

15. Footwear as set forth in claim 13 wherein said second area further comprises the medial region of the heel section.

* * * * *